United States Patent [19]

Gisske et al.

[11] Patent Number: 4,904,916

[45] Date of Patent: Feb. 27, 1990

[54] ELECTRICAL CONTROL SYSTEM FOR STAIRWAY WHEELCHAIR LIFT

[75] Inventors: Edward T. Gisske, Verona; John F. Prendergast, Sr., Franklin, both of Wis.

[73] Assignee: The Cheney Company, New Berlin, Wis.

[21] Appl. No.: 195,251

[22] Filed: May 18, 1988

[51] Int. Cl.[4] ..... B66B 9/06

[52] U.S. Cl. ..... 318/649; 318/648; 318/16; 455/603; 307/149; 414/546; 414/391; 187/12; 187/17; 212/160; 182/2

[58] Field of Search ..... 318/16, 648, 649; 187/1 R, 8.52, 8.65, 8.69, 9 R-19, 32, 100; 414/391, 399, 449, 462, 539, 540, 541, 546, 545, 556, 787, 921; 212/159, 121, 224; 455/600-612; 340/825.69, 825.72; 280/166, 5.22, 5.26, DIG. 10; 296/62; 180/8.2, 907; 297/316, DIG. 4, DIG. 10, 149; 182/2, 148

[56] References Cited

U.S. PATENT DOCUMENTS

| | | | |
|---|---|---|---|
| 3,774,217 | 11/1973 | Bonner et al. | 182/148 X |
| 3,809,182 | 5/1974 | Wilson | 182/148 |
| 4,095,704 | 6/1978 | Ratliff | 414/556 |
| 4,179,012 | 12/1979 | Heberle | 187/17 X |
| 4,335,805 | 6/1982 | Grass | 187/12 |
| 4,430,652 | 2/1984 | Rothenbuhler et al. | 212/160 X |
| 4,438,830 | 3/1984 | Born | 187/12 |
| 4,576,539 | 3/1986 | Williams | 414/391 |
| 4,627,517 | 12/1986 | Bor | 187/12 |
| 4,674,601 | 6/1987 | Benjamin | 414/546 X |
| 4,679,653 | 7/1987 | Pasquarette et al. | 182/2 |
| 4,740,712 | 4/1988 | Michaud | 307/149 |
| 4,762,199 | 8/1988 | Holmes | 182/2 |
| 4,809,359 | 2/1989 | Dockery | 455/603 |

*Primary Examiner*—William M. Shoop, Jr.
*Assistant Examiner*—Paul Ip
*Attorney, Agent, or Firm*—Michael, Best & Friedrich

[57] ABSTRACT

A stairway wheelchair lift includes a stationary motor drive unit, a mobile platform movable along a stairway and a user interface for receiving user-generated input commands. The mobile platform communicates with the motor drive unit through a continuously maintained broadbeam infrared communications link, while the motor drive unit communicates with the mobile platform through an intermittently established short range infrared link. The user interface communicates with the motor drive through a hard wired four conductor communicates link. The use of infrared communications links, together with the four conductor hard wired link, reduces overall system wiring, enhances ease of installation and improves overall system flexibility and economy. Microprocessor based micro-controllers, within the motor drive unit, the mobile platform and the user interface, permit system operation to be tailored in accordance with the operating constraints and requirements imposed by a particular stairway configuration.

48 Claims, 4 Drawing Sheets

ELECTRICAL CONTROL SYSTEM FOR STAIRWAY WHEELCHAIR LIFT

RELATED APPLICATION

Reference is made to the copending application of David W. Wendt, entitled, "Stairway Wheelchair Lift" filed concurrently herewith, incorporated by reference herein, and assigned to the assignee hereof.

BACKGROUND OF THE INVENTION

This invention relates generally to lift mechanisms and, more particularly, to electrical control systems for controlling the operation of stairway wheelchair lifts operable to transport handicapped people in ascending and descending directions along a stairway.

Stairway wheelchair lifts, that operate to carry wheelchair-bound passengers in ascending and descending directions along a stairway, are particularly well suited for use in applications, such as in smaller multistory structures having four or fewer floors, wherein elevators are impractical. In particular, stairway wheelchair lifts are able to utilize existing stairways and, thus, avoid the need for separate, special, architectural consideration. However, because stairway wheelchair lifts are called upon to operate within the confines of existing stairways, and because such stairways can differ considerably from structure to structure, it is desirable that stairway wheelchair lifts be readily adaptable for installation within stairways which each impose a unique set of physical and operational constraints.

To maximize both utility and safety, it is desirable that stairway wheelchair lifts provide operation which is, to at least some extent, dictated by the physical constraints imposed by the stairway itself. For example, it may desirable to reduce the speed of the lift at times in order to avoid potentially hazardous accelerations as the lift turns sharp corners. In addition, overall utility is increased and greatest economy is obtained, if a single basic system can be easily adapted for use in structures having two, three or four stories.

Although the mechanical features of a stairway wheelchair lift greatly influence the overall flexibility of the lift, an electrical control system for operating such a lift can further affect overall system flexibility, economy and effectiveness. Those electrical control systems which provide maximum system flexibility in combination with minimum complexity, particularly with regard to permanent wiring within the stairway, are to be preferred.

In view of the foregoing, it is a general object of the present invention to provide a new and improved electrical control system for stairway wheelchair lifts.

It is a more specific object of the present invention to provide a new and improved electrical control system for stairway wheelchair lifts which is readily adaptable for use with stairway wheelchair lifts operating under various unique constraints imposed by a particular stairway.

It is a still more specific object of the present invention to provide a new and improved electrical control system for stairway wheelchair lifts which promotes overall system flexibility and permits the use of a single basic system in a variety of different stairways and situations.

SUMMARY OF THE INVENTION

The invention provides an electrical control system for controlling the operation of a wheelchair lift having a stationary motor drive unit, a mobile platform operated by the motor drive unit and a remote call button station adapted to receive user-generated control instructions. The electrical control system comprises a first communications link adapted to communicate the user-generated control instructions from the remote call button station to the motor drive unit and a second communications link, including wireless transmitting means, for communicating the user-generated control instructions from the motor drive unit to the mobile platform. The electrical control system further comprises a third communications link including additional wireless transmitting means for communicating motor control commands from the mobile platform to the motor drive unit.

The invention also provides a control system for controlling the operation of a wheelchair lift of the type adapted for carrying a passenger along a stairway between upper and lower landings and including a rail mounted along the stairway, a passenger lift platform mounted for movement along the rail and a motor drive unit adapted to drive the passenger lift platform along the rail. The control system comprises remote passenger interface means for generating system control instructions in response to user-applied control inputs. The control system further includes motor control means for controlling operation of the motor in response to application of motor control instructions and further includes first communicating means for communicating the system control instructions from the remote passenger interface means to the motor control means. The control system further includes platform control means for controlling operation of the passenger lift platform in response to application of the system control instructions, and second communicating means including an infrared link for sensing the position of the passenger lift platform relative to the stairway, for communicating the system control instructions from the motor control means to the passenger lift platform, and for communicating the motor control instructions from the passenger lift platform to the motor control means in accordance with the location of the passenger lift platform relative to the stairway.

BRIEF DESCRIPTION OF THE DRAWINGS

The features of the present invention which are believed to be novel are set forth with particularity in the appended claims. The invention, together with the further objects and advantages thereof, may best be understood by reference to the following description, taken in conjunction with the accompanying drawings, in the several figures of which like reference numerals identify like elements, and in which:

DESCRIPTION OF THE PREFERRED EMBODIMENT

Figure 2:
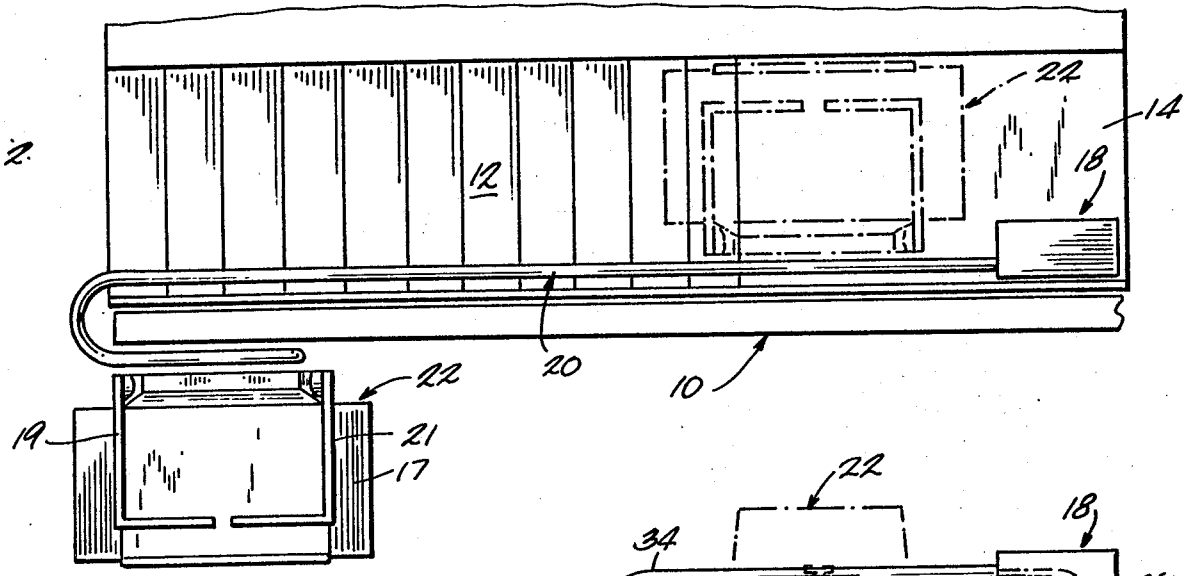
FIG. 2 is a top plan view of the stairway and stairway lift mechanism illustrated in FIG. 1.
Figure 1:
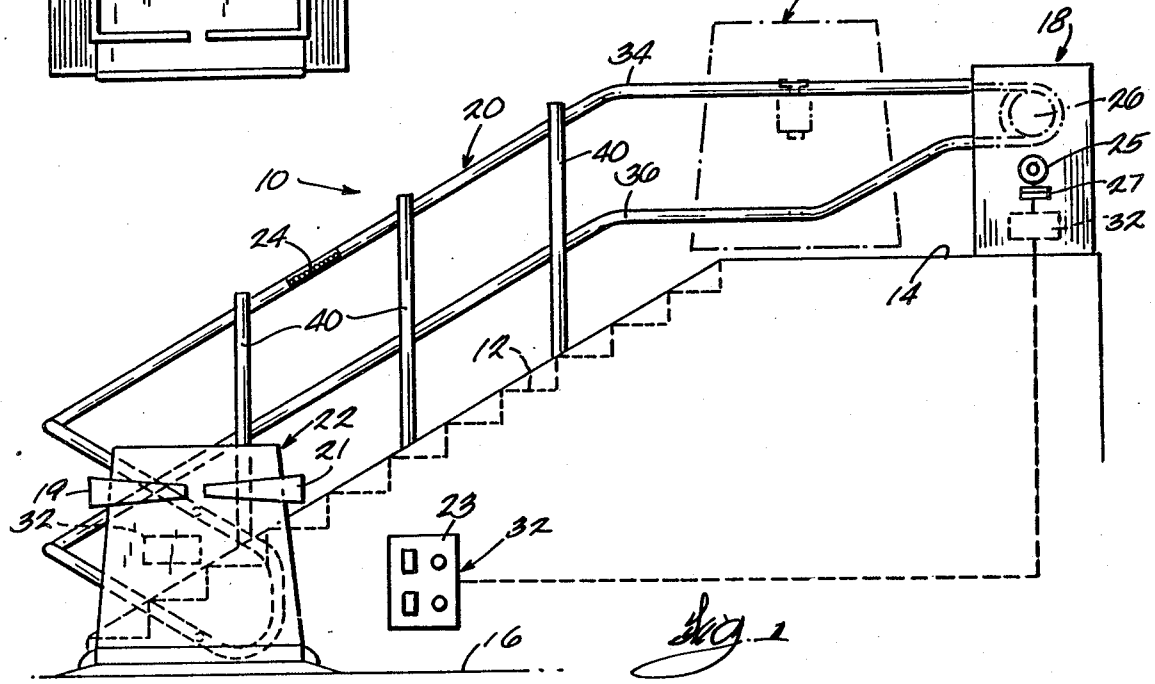
FIG. 1 is a side elevational view of a stairway having as therewith a stairway lift mechanism including an electrical control system embodying various features of the invention.
Figure 3:
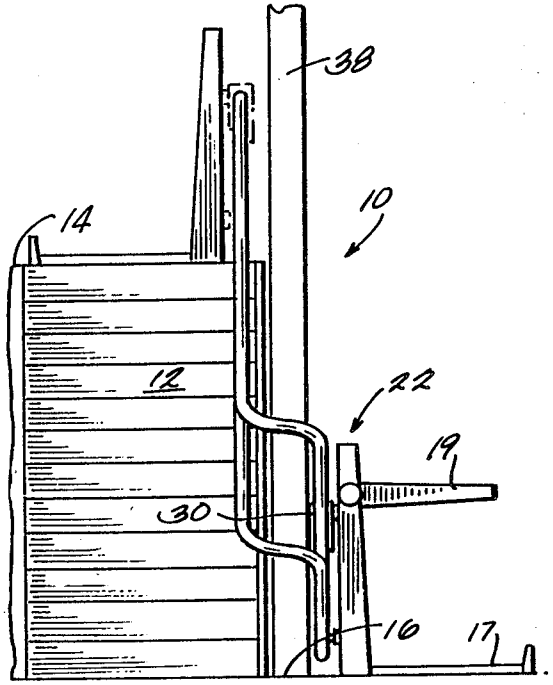
FIG. 3 is a front elevational view of the stairway and stairway lift mechanism illustrated in FIGS. 1 and 2.

Referring to the drawings, and, in particular, to FIGS. 1, 2 and 3, a stairway wheelchair lift mechanism 10 is shown installed along a stairway 12 in a multi-story structure. The lift mechanism 10 is operable to transport a wheelchair-bound passenger between two or more vertically displaced locations, such as upper and lower landings 14 and 16, separated by the stairway. Although the illustrated lift mechanism 10 is adapted for transporting a passenger between only two floors of the multi-story structure, it will be appreciated that the mechanism can be readily adapted for use in structures having more than two floors.

As illustrated, the stairway lift mechanism includes a motor drive unit 18 located at the upper landing, a rail assembly 20 extending from the motor drive unit to the lower landing 16 along the stairway 12, and a passenger lift platform 22 adapted to support and move a passenger along the rail assembly 20. A closed loop chain 24 is disposed within the hollow interior of the rail assembly, and the motor drive unit 18 includes a sprocket 26, driven by a motor 25, adapted to operatively drive the chain 24 for bi-directional movement within the hollow rail. A motor control 27 controllably selects the speed and direction of the motor 25. The passenger lift platform 22 includes a carrier system having an upper carrier assembly 30 which is coupled to the chain 24 and which allows the passenger lift platform 22 to ride along the rail assembly 20 in response to driving movement of the chain 24.

The rail assembly 20 provides a pair of substantially parallel, vertically spaced upper and lower guide rails 34 and 36 extending along one wall 38 of the stairway 12 between the upper landing 14 and the lower landing 16. As illustrated, the rigid tubing forming the rail assembly 20 is shaped so as to conform generally to the course of the stairway 12. The rail assembly is supported above, and generally parallel to, the stairway by means of a plurality of stanchions 40 projecting upwardly from the stairway. Alternatively, the rail assembly can be supported on a plurality of supports (not shown) extending outwardly from the wall 38 along the stairway.

The rail assembly 20 is installed along one side of the stairway adjacent the wall 38. One or more user-actuatable remote call button stations 23 are located at the various landings along the stairway 12.

An electrical control system 32, having components located within the motor drive unit 18, the passenger lift platform 22 and along the stairway 12 itself, is provided for controlling the overall operation of the stairway lift mechanism 10. In particular, the electrical control system 32 functions to sense the position of the passenger lift platform 22 and to control movement of the passenger lift platform 22 in accordance with the position of the platform and in accordance with various commands generated both by users and by the system itself.

As illustrated, the passenger lift platform 22 provides a stable horizontal platform surface capable of supporting thereon a wheelchair-bound passenger. The passenger lift platform 22 is capable of movement in both the ascending and descending directions along the stairway 12 between the upper and lower landings 14 and 16 and can thus function to transport the passenger between the landings in either direction along the stairway.

The passenger lift platform includes a lower platform 17 which can be raised for storage or lowered for use. In addition, the passenger lift platform 22 includes a pair of right and left guard arms 19 and 21 which are adapted to rotate between raised and lowered positions over the lower platform 17.

Referring to FIGS. 4-7, the electrical control system 32 for controlling operation of the stairway wheelchair lift preferably comprises a distributed, network of microprocessor-based single chip micro-controllers. One micro-controller 42 is located in the passenger lift platform 22 and operates to control the folding and unfolding of the right and left guard arms 19 and 21 and the lower platform 17. This micro-controller 42 also functions to receive user-generated control commands entered through a user control panel 44 included on the passenger lift platform 22. Another micro-controller 46 is located in the motor drive unit 18 and functions to control motor operation and communication with the remote call button stations 3. Additional micro-controllers 48 (FIG. 5) are located within each of the remote call button stations 23 and function to transmit and receive serial communications to and from the motor drive unit micro-controller 46. Typically, two to four remote call button stations 23 are included in any given installation.

The platform and motor control micro-controllers 42 and 46 communicate via a bi-directional infrared data link. To this end, a plurality of stationary overhead infrared receiver modules 50 are located along the stairway, and an upwardly directed mobile infrared transmitter module 52, preferably including an infrared emitting diode (IRED) 54, is carried along with the passenger lift platform 22. The infrared transmitter module 52 radiates a broad, upwardly directed, infrared carrier from the movable passenger lift platform 22, and the overhead infrared receiver modules 50 are located so that at least one of the receiver modules 50 receives the radiated infrared carrier at all times regardless of the position of the passenger lift platform 22 along the stairway 12. Data transmitted by the mobile infrared transmitter module 52, and received by the stationary infrared receiver modules 50, are communicated to the motor drive unit micro-controller 46 via a hard wired data bus or link 56.

In addition to the foregoing, an additional, mobile, infrared receiver module 58 is carried by the passenger lift platform 22, and a plurality of stationary infrared transmitter modules 60 are position at predetermined locations along the stairway. Unlike the previously described mobile infrared transmitter module 52 and stationary overhead receiver modules 50, the additional mobile receiver and stationary transmitter modules 58 and 60 are arranged so that a data link is established between the passenger platform receiver module 58 and the additional transmitter modules 60 only when the passenger platform 22 is at pre-selected locations along the stairway 12. To this end, the stationary infrared transmitter modules 60 are preferably located on or in the wall 38 behind the rail assembly 20 and are arranged to radiate a relatively narrow beamwidth infrared carrier outwardly from the wall. In addition, the mobile infrared receiver 58 is positioned adjacent the rear of the passenger lift platform 22 so as to move into registry with the individual stationary infrared transmitter modules 60 when the passenger lift platform 22 reaches pre-selected locations along the stairway 12. Data, generated by the motor drive unit mirco-controller 46, are communicated to the stationary infrared transmitter modules 60 via an additional hard-wired data bus or link 62 and are thereafter communicated to the passenger platform micro-controller 42 via the short range infrared transmitters and receivers 58 and 60.

Communication between the remote call button stations 23 and the motor drive unit 18 is provided by means of a four-wire link 64. Two of the wires 66 and 68 are dedicated to conveying DC current from a power supply 69, within the motor drive unit 18, to each of the individual call button stations 23. A third wire 70 is dedicated to conveying serial data from the motor drive unit 18 to the call button stations 23, while the fourth conductor 72 is dedicated to conveying serial data from the individual call button stations 23 to the motor drive unit 18.

Figure 4:
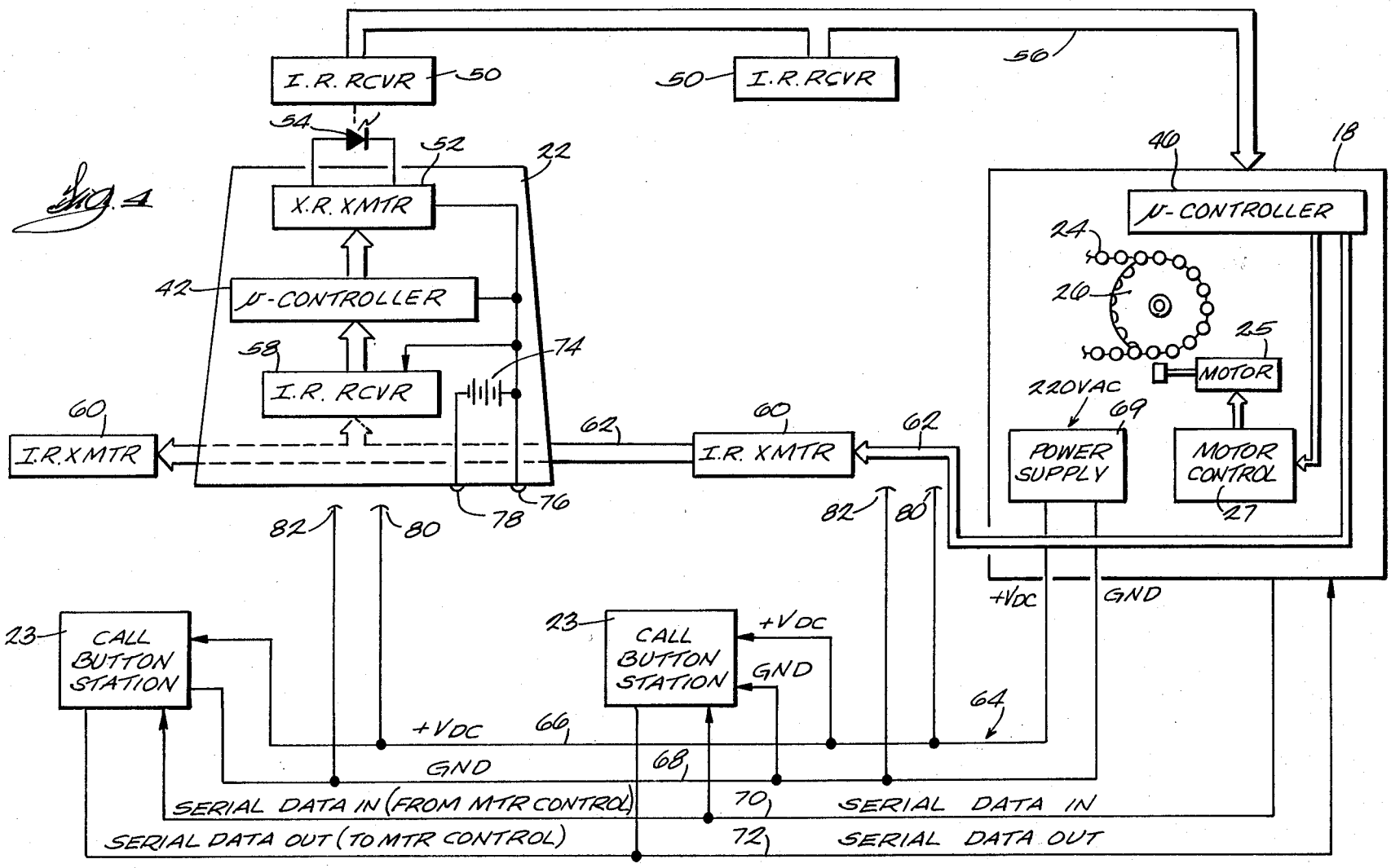
FIG. 4 is a simplified block diagram of a stairway ft electrical control system embodying various features of the invention.

As further illustrated in FIG. 4, the circuitry of the passenger lift platform 22 is energized by means of a self-contained storage battery 74. Current for recharging the battery 74 is supplied from the power supply 69 within the motor drive unit 18, through the two conductors 66 and 68, and to the passenger lift platform 22 through a set of contacts 76 and 78 which engage a complementary set of contacts 80 and 82 when the passenger lift platform 22 is at pre-selected locations along the stairway. Preferably, such a complementary pair of contacts 80 and 82 is provided at each landing so that the platform battery 74 can be recharged while the platform 22 is standing idle at any one of the landings.

Figure 5:
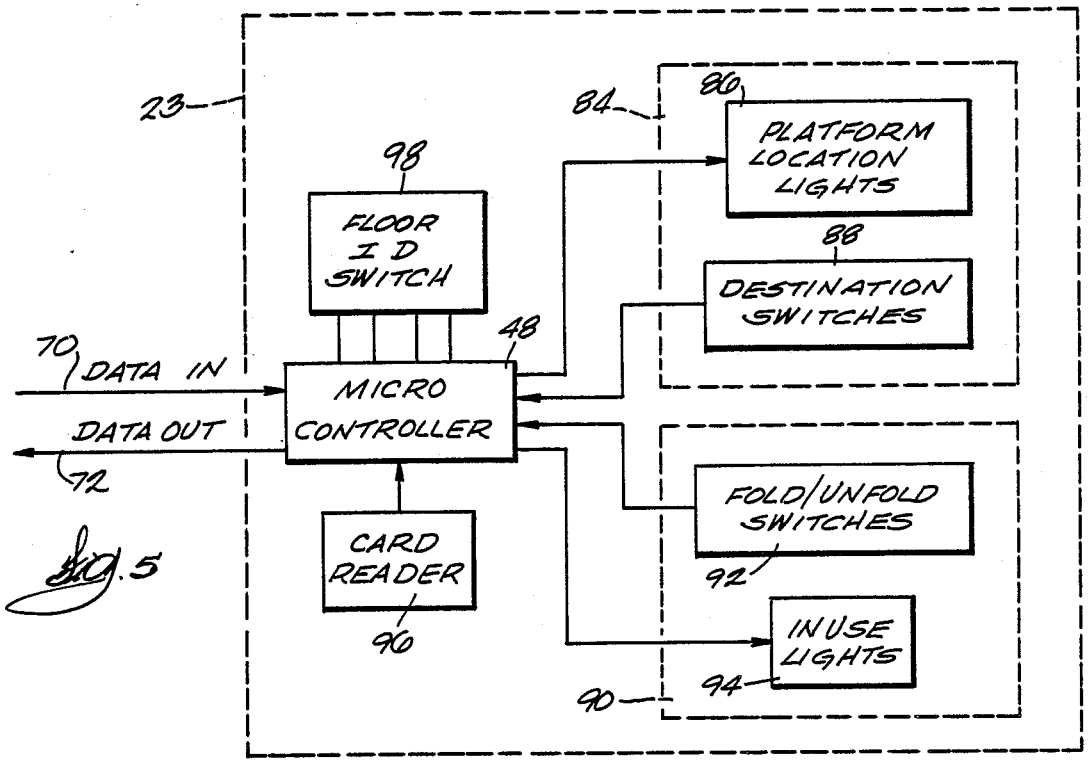
FIG. 5 a block diagram of an electrical control for a remote call button station incorporated in the electrical control system shown in FIG. 1.

As illustrated in FIG. 5, each remote call button station 23 includes a pendant unit switch assembly 84 having a plurality of user-visable platform location lights 86 and a plurality of user-actuatable destination switches 88. The platform location lights 86 serve to indicate the current location of the passenger lift platform 22, while the destination switches 88 can be used to direct the passenger lift platform 22 to various pre-selected destinations along the stairway 12. Each remote call button station 23 further includes a wall switch unit assembly 90 having user-actuatable fold and unfold switches 92 and a user-visable "in use" light or lights 94. The fold and unfold switches 92 operate to cause the guard arms 19 and 21 and lower platform 17 of the passenger lift platform 22 to fold upwardly into a storage position or to unfold downwardly for use. The "in use" lights 94 notify a user when the stairway wheelchair lift is in use at some remote location.

When desired, controlled access to use of the wheelchair lift 10 can be provided. To this end, an optional card reader 96 can be included in the remote call button stations 23, and pre-coded cards can be issued to authorized users of the wheelchair lift. By inhibiting operation of the remote call button station 23 in the absence of a valid card in the card reader 96, unauthorized use of the wheelchair lift 10 can be controlled.

Each remote call button station 23 further includes a floor identification or "ID" switch 98 which is set to a unique code indicative of the particular location of the individual remote call button station 23 along the stairway. Inputs from the floor ID switch 98, as well as from the card reader 96, the destination switches 88 and the fold and unfold switches 92, are communicated to the remote call button micro-controller 48. In addition, data communicated from the motor drive unit 18 through the four wire link 64 are also applied to the micro-controller 48. The micro-controller 48, in turn, provides outputs for actuating the appropriate platform location lights 86 as well as the in use lights 94, and further communicates data from the micro-controller 48 to the motor drive unit 18 through the four wire link 64.

In response to user-actuation of either the destination switches 88 or the fold and unfold switches 92, the remote call button station micro-controller 48 generates a series of appropriate system control instructions or commands and transmits these commands to the micro-controller 46 of the motor drive unit 18 through the four wire link 64. In addition, the remote call button station micro-controller 48 transmits a unique identification code, derived from the floor ID switch 98, so that the motor drive unit micro-controller 46 can determine the source of data received through the four wire link 64.

Figure 6:
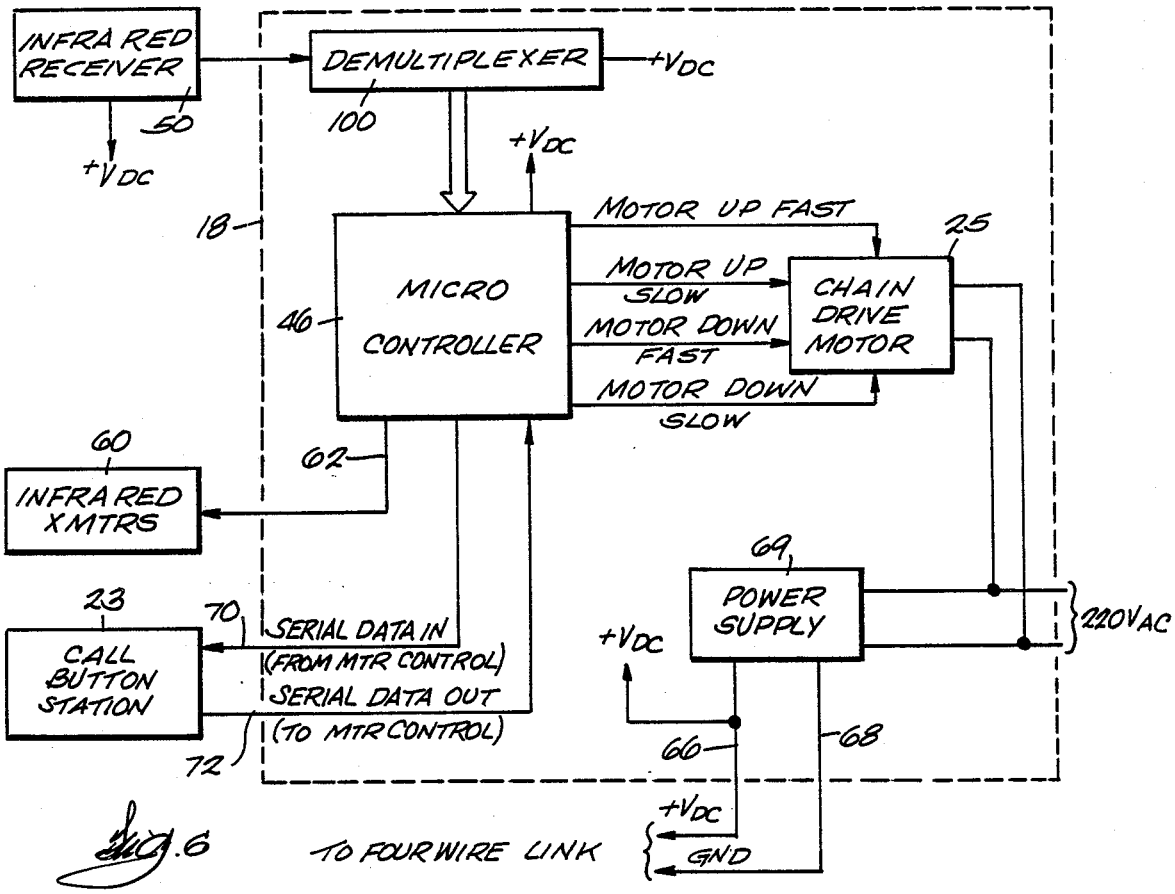
FIG. 6 is a block diagram of an electrical control system for a motor drive unit incorporated in the electrical control system illustrated in FIG. 1.

Referring to FIG. 6, the micro-controller 46 of the motor drive unit 18 operates to provide various motor commands to the motor control 27 for controlling both the direction and speed of the chain drive motor 25.

Each of the stationary overhead infrared receivers 50 is coupled to a demultiplexer 100 which, in turn, conveys received data to the micro-controller 46. Data or commands, generated by the micro-controller 46 and intended for the passenger lift platform 22, are conveyed to the stationary infrared transmitters 60 for further transmission to the passenger lift platform 22. Data to and from the remote call button stations 23 are communicated through the four wire link 64.

Figure 7:
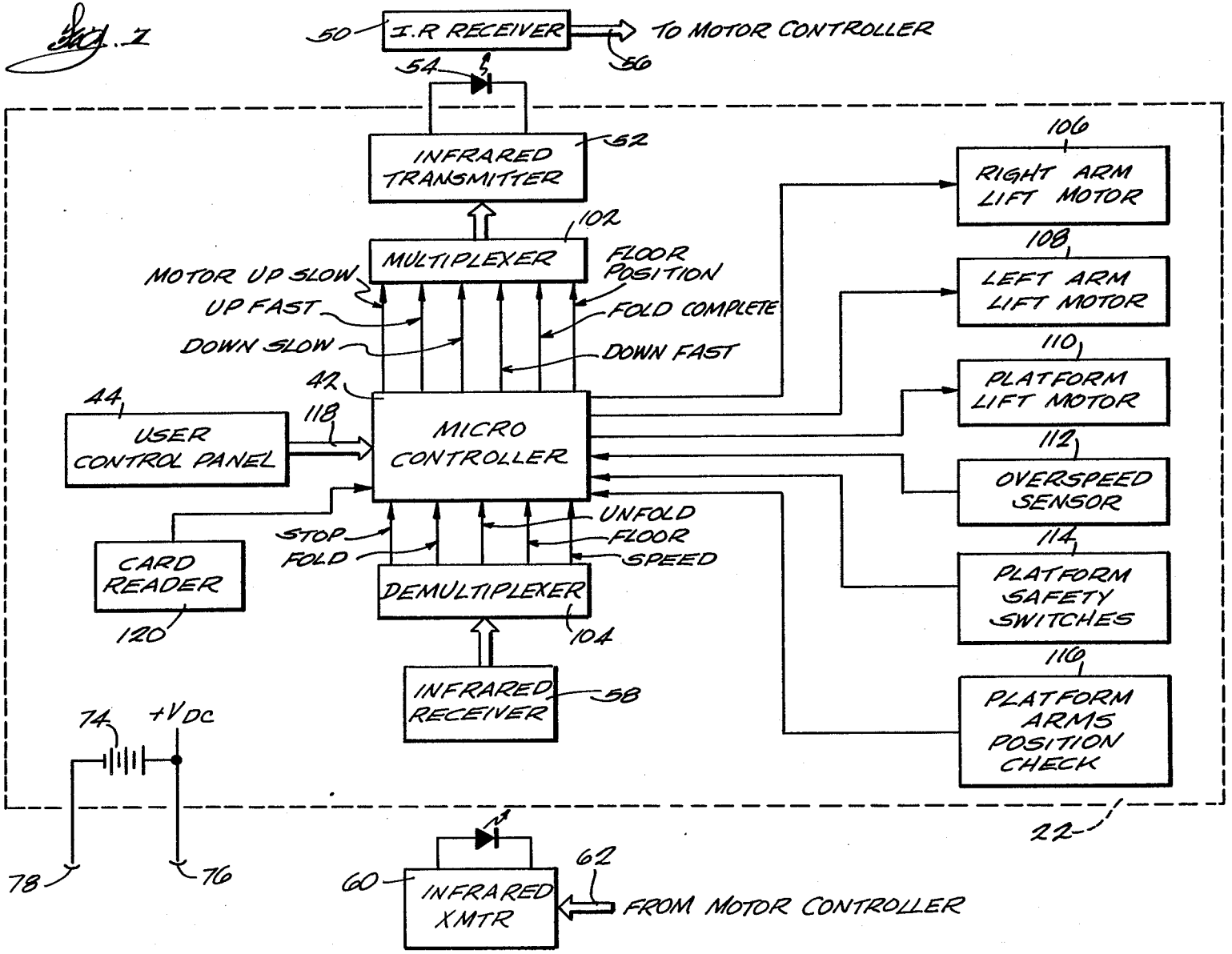
FIG. 7 is a block diagram of an electrical system for use in a passenger lift platform incorporated in the electrical control system shown in FIG. 1.

Referring to FIG. 7, the micro-controller 42 of the passenger lift platform 22 is coupled through a multiplexer 102 to the mobile infrared transmitter 52, and the mobile infrared receiver 58 is coupled to the micro-controller 42 through a demultiplexer 104. In this manner, commands from the micro-controller 42 can be transmitted to the micro-controller 46 of the motor drive unit 18 through the overhead infrared link (transmitter 52 and receivers 50) and can be transmitted from the micro-controller of the motor drive unit through the temporarily established short range infrared link (transmitters 60 and receiver 58).

In addition to the foregoing, the passenger lift platform 22 includes separate hydraulically or electrically actuated motors 106 and 108 for raising and lowering the right and left guard arms 19 and 21 respectively, and further includes an additional hydraulic or electric motor 110 for raising and lowering the lower platform 17. An overspeed sensor 112 is provided for generating a control signal when the speed of the passenger lift platform 22 relative to the rail assembly 20 exceeds a predetermined limit, and various platform safety switches 114 are included for sensing the presence of a passenger on the lower platform 17 as well as for sensing obstructions in the path of the moving platform 22. Still other switches 116 are provided for sensing the position of the lower platform 17 and the right and left guard arms 19 and 21.

The user control panel 44, includes inputs and outputs similar or identical to those of the remote call button stations 23, and is coupled through a data bus 118 to the micro-controller 42. An optional card reader 120, similar or identical to the card reader(s) 96 of the remote call button stations 23, can be included. The card reader 120 provides an enabling control signal to the micro-controller 42 when a valid card is present in the reader 120.

In operation, system control instructions, developed by the remote call button stations 23 in response to user inputs, are communicated, through the micro-controller 46 of the motor drive unit, through the four wire link 64, and from the motor drive unit 18, to the passenger lift platform 22 through the short range infrared link established by the stationary infrared transmitters 60 and the mobile receiver 58. The micro-controller 42 within the passenger platform 22 then monitors the present operational status of the stairway wheelchair lift in order to determine what action is to be taken next. If the passenger lift platform 22 is in the process of moving from one location to another at the time a command is received from any of the remote call button stations 23, the passenger lift platform 22 completes its journey before taking action on the received commands. Once previously received commands have been fully executed, the passenger lift platform 22 is then free to execute currently received commands.

When the micro-controller 42 within the passenger lift platform 22 determines that the passenger lift platform 22 is free to execute currently received commands, the micro-controller 42 generates an appropriate series of motor control commands and communicates these commands to the motor drive unit 18 through the overhead infrared link. Upon receiving these commands, the micro-controller 46 within the motor drive unit 18 instructs the motor control 27 to operate the chain drive motor 25 in the appropriate direction and at the appropriate speed.

The stationary, short range infrared transmitters 60 along the route of the passenger lift platform 22 serve not only to convey operational commands from the motor drive unit 18 to the passenger lift platform 22, but also function to signal the passenger lift platform 22 that it has reached certain pre-selected locations along the stairway 12. For example, it is sometimes desirable to reduce the speed of the passenger lift platform 22 as the platform rounds a curve or turns a corner during its travels along the stairway 12. By positioning separate ones of the stationary short range infrared transmitters 60 above and below a sharp curve or corner, the micro-controller 42 of the passenger lift platform 22 can, by taking the direction of travel into account, determine when motor speed should be reduced for rounding the corner and when motor speed should be increased after the corner is turned. Additional stationary short range infrared transmitters 60, located at the stairway landings 14 and 16, provide a fixed stop position for the passenger lift platform 22 to ensure that the passenger lift platform 22 always stops at the same location at each landing.

The micro-controller 42 within the passenger lift platform 22 also functions to develop the appropriate commands for raising and lowering the guard arms 19 and 21 and lower platform 17. In addition, the micro-controller 42 monitors the overspeed sensor 112 and actuates a mechanical brake mechanism in the event the speed of the passenger lift platform 22 exceeds a predetermined upper limit. Finally, the micro-controller 42 monitors the various platform safety switches 114 and signals the chain drive motor 25, through the overhead infrared link, to stop when any one of the platform safety switches 114 detects an obstruction along the stairway 12 or some other unsafe operating condition. Preferably, the micro-controller 42, after stopping the motor 25 due to actuation of any of the platform safety switches 114, thereafter permits controlled actuation of the motor 25 in order to permit the passenger lift platform 22 to be backed out of a jammed condition.

The electrical control system herein shown and described permits great system flexibility with a minimum of hard wired interconnections between the various system elements. Because communication between the stationary motor drive unit 18 and the mobile passenger lift Platform 22 is provided through wireless infrared data links, it is unnecessary to maintain a continuous hard wired connection between the motor drive unit and the passenger lift platform. The various stationary overhead infrared receivers 50 and short range infrared transmitters 60 can be placed wherever appropriate in any particular stairway and installation. The use of a four wire serial data link 64 between the various call button stations 23 and the motor drive unit 18 reduces the overall hard wiring of the wheel chair lift mechanism and further contributes to system flexibility and economy. Finally, because the circuitry of the passenger lift platform 22 is powered by a self-contained battery 74, it is unnecessary to maintain a continuous power link to the passenger lift platform 22 as the platform moves between various locations along the stairway 12.

It will be appreciated that the use of suitably programmed micro-controllers 42, 46 and 48 in the passenger lift platform 22, the motor drive unit 18 and the remote call button stations 23 permits operation of the wheelchair lift mechanism to be tailored for any particular need or special situation. Through use of suitable programming, a variety of desired operating features can be easily and economically obtained.

While a particular embodiment of the invention has been shown and described, it will be obvious to those skilled in the art that changes and modifications may be made without departing from the invention in its broader aspects and, therefore, the aim in the appended claims is to cover all such changes and modifications as fall within the true spirit and scope of the invention.

We claim:

1. An electrical control system for controlling the operation of a wheelchair lift of the type adapted for carrying a wheelchair and a wheelchair occupant along a stairway between upper and lower landings, and having a stationary motor drive unit, a mobile platform operated by the motor drive unit and a remote call button station adapted to receive user-generated control instructions, said electrical control system comprising:

a first communications link adapted to communicate the user-generated control instructions from the remote call button station to the motor drive unit;

a second communications link including wireless transmitting means for communicating the user-generated control instructions from the motor drive unit to the mobile platform; and a third communications link including additional wireless transmitting means for communicating motor control commands from the mobile platform to the motor drive unit.

2. An electrical control system in accordance with claim 1 wherein said wireless transmitting means of said second communications link and said additional wireless transmitting means of said third communications link each comprise infrared communications links.

3. An electrical control system in accordance with claim 2 wherein said second communications link is established when the mobile platform is at pre-selected locations along a stairway and is broken when the mobile platform is other than at one of said pre-selected locations.

4. An electrical control system in accordance with claim 3 wherein said third communications link remains continuously established regardless of the position of the mobile platform along the stairway.

5. An electrical control system in accordance with claim 4 wherein said first communications link comprises a hard wired link extending between the remote call button station and the motor drive unit.

6. An electrical control system in accordance with claim 5 wherein said hard wired link comprises four separate conductors extending from the remote call button station to the motor drive unit.

7. An electrical control system in accordance with claim 4 wherein said third communications link includes an infrared transmitter carried on the mobile platform and one or more infrared receivers positioned above the mobile platform.

8. A control system for controlling the operation of a wheelchair lift of the type adapted for carrying a passenger along a stairway between upper and lower landings and including a rail mounted along the stairway, a passenger lift platform mounted for movement along the rail, and a motor drive unit having a motor adapted to drive the passenger lift platform along the rail, said control system comprising:

remote passenger interface means for generating system control instructions in response to user-applied control inputs;

motor control means for controlling operation of the motor in response to applied motor control instructions;

first communicating means for communicating said system control instructions from said remote passenger interface means to said motor control means;

platform control means for controlling operation of the passenger lift platform in response to application of said system control instructions; and second communicating means including a bi-directional infrared link for sensing the position of the passenger lift platform relative to the stairway, for communicating the system control instructions from said motor control means to the passenger lift platform, and for communicating the motor control instructions from the passenger lift platform to said motor control means in accordance with the location of the passenger lift platform along the stairway.

9. A control system in accordance with claim 8 wherein said remote passenger interface means includes at least one remote call button station located at a pre-selected location along the stairway.

10. A control system in accordance with claim 9 wherein said remote call button station includes a micro-controller adapted to generate the system control instructions in response to the user-applied control inputs.

11. A control system in accordance with claim 8 wherein said platform control means is adapted to develop the motor control instructions in response to application of the system control instructions.

12. A control system in accordance with claim 11 wherein said platform control means includes a micro-controller adapted to develop the motor control instructions in response to application of the system control instructions.

13. A control system in accordance with claim 12 wherein said motor control means includes a micro-controller adapted to control the motor in accordance with the applied motor control instructions.

14. A control system in accordance with claim 8 wherein said second communicating means includes a first infrared link for communicating the motor control instructions from the passenger lift platform to the motor drive unit.

15. A control system in accordance with claim 14 wherein said first infrared link includes mobile infrared transmitter mounted on and movable with the passenger lift platform, and at least one stationary infrared receiver positioned overhead along the stairway so as to receive an infrared signal emitted by said mobile infrared transmitter.

16. A control system in accordance with claim 15 wherein said second communicating means further includes a second infrared link for communicating the system control instructions from said motor control means to the passenger lift platform.

17. A control system in accordance with claim 16 wherein said second infrared link includes a mobile infrared receiver mounted on and movable with said passenger lift platform and at least one stationary infrared transmitter located at a pre-selected location along the stairway, said second infrared receiver and said second infrared transmitter being arranged so that said second infrared link is established only when said passenger lift platform is substantially at said pre-selected location along the stairway.

18. A control system in accordance with claim 17 wherein one of said stationary infrared transmitters is located at each location along the stairway at which said passenger lift platform stops to embark and disembark a passenger.

19. A control system in accordance with claim 18 wherein additional ones of said stationary infrared transmitters are located at additional pre-selected locations along the stairway between which locations it is desirable to vary the speed of movement of the passenger lift platform along the rail.

20. A control system in accordance with claim 19 wherein said control system further includes means for modifying said motor control instructions in accordance with the establishment of said second infrared link as the passenger lift platform reaches various ones of said pre-selected locations along the stairway.

21. A wheelchair lift comprising:

a stationary motor drive unit, a mobile platform operated by the motor drive unit, a remote call button station adapted to receive user-generated control instructions, and an electrical control system having a first communications link adapted to communicate the user-generated control instructions from said remote call button station to said motor drive unit, a second communications link including wireless transmitting means for communicating the user-generated control instructions from said motor drive unit to said mobile platform, and a third communications link including additional wireless transmitting means for communicating motor control commands from said mobile platform to said motor drive unit.

22. A wheelchair lift in accordance with claim 21 wherein said wireless transmitting means of said second communications link and said additional wireless transmitting means of said third communications link each comprise infrared communications links.

23. A wheelchair lift in accordance with claim 22 wherein said second communications link is established when said mobile platform is at pre-selected locations along a stairway and is broken when said mobile platform is other than at one of said pre-selected locations.

24. A wheelchair lift in accordance with claim 23 wherein said third communications link remains continuously established regardless of the position of said mobile platform along the stairway.

25. A wheelchair lift in accordance with claim 24 wherein said first communications link comprises a hard wired link extending between said remote call button station and said motor drive unit.

26. A wheelchair lift in accordance with claim 25 wherein said hard wired link comprises four separate conductors extending from said remote call button station to said motor drive unit.

27. A wheelchair lift in accordance with claim 24 wherein said third communications link includes an infrared transmitter carried on the mobile platform and one or more infrared receivers positioned above said mobile platform.

28. A wheelchair lift of the type adapted for carrying a passenger along a stairway between upper and lower landings, said lift comprising a rail mounted along the stairway, a passenger lift platform mounted for movement along the rail, and a motor drive unit having a motor adapted to drive said passenger lift platform along said rail, and a control system including remote call button means for generating system control instructions in response to user-applied control inputs, motor controller means for controlling operation of said motor in response to applied motor control instructions, first communicating means for communicating said system control instructions from said remote call button means to said motor controller means, platform controller means for controlling operation of said passenger lift platform in response to application of said system control instructions, and second communicating means including a bi-directional infrared link for sensing the position of said passenger lift platform relative to the stairway, for communicating the system control instructions from said motor controller means to said passenger lift platform, and for communicating the motor control instructions from said passenger lift platform to said motor controller means in accordance with the location of said passenger lift platform along the stairway.

29. A wheelchair lift in accordance with claim 28 wherein said remote call button means is located at a pre-selected location along the stairway.

30. A wheelchair lift in accordance with claim 29 wherein said remote call button means includes a microcontroller adapted to generate the system control instructions in response to the user-applied control inputs.

31. A wheelchair lift in accordance with claim 28 wherein said platform controller means is adapted to develop the motor control instructions in response to application of the system control instructions.

32. A wheelchair lift in accordance with claim 31 wherein said platform controller means includes a micro-controller adapted to develop the motor control instructions in response to application of the system control instructions.

33. A wheelchair lift in accordance with claim 32 wherein said motor controller means includes a microcontroller adapted to control the motor in accordance with the applied motor control instructions.

34. A wheelchair lift in accordance with claim 28 wherein said second communicating means includes a first infrared link for communicating the motor control instructions from said passenger lift platform to said motor drive unit.

35. A wheelchair lift in accordance with claim 34 wherein said first infrared link includes a mobile infrared transmitter mounted on and movable with said passenger lift platform, and at least one stationary infrared receiver positioned overhead along the stairway so as to receive an infrared signal emitted by said mobile infrared transmitter.

36. A wheelchair lift in accordance with claim 35 wherein said second communicating means further includes a second infrared link for communicating the system control instructions from said motor control means to said passenger lift platform.

37. A wheelchair lift in accordance with claim 35 wherein said second infrared link includes a mobile infrared receiver mounted on and movable with said passenger lift platform and at least one stationary infrared transmitter located at a pre-selected location along the stairway, said second infrared receiver and said second infrared transmitter being arranged so that said second infrared link is established only when said passenger lift platform is substantially at said pre-selected location along the stairway.

38. A wheelchair lift in accordance with claim 37 wherein one of said stationary infrared transmitters is located at each location along the stairway at which said passenger lift platform stops to embark and disembark a passenger.

39. A wheelchair lift in accordance with claim 38 wherein additional ones of said stationary infrared transmitters are located at additional pre-selected locations along the stairway between which locations it is desirable to vary the speed of movement of said passenger lift platform along said rail.

40. A wheelchair lift in accordance with claim 39 wherein said control system further includes means for modifying said motor control instructions in accordance with the establishment of said second infrared link as the passenger lift platform reaches various ones of said pre-selected locations along the stairway.

41. A wheelchair lift comprising a stationary motor, a mobile platform driven by the stationary motor, and adapted for carrying a wheelchair and its occupant along a stairway, between upper and lower landings, and a control system including a wireless transmitter on the mobile platform and movable with said platform, a receiver on the stairway, separate from said platform, and adapted to receive a command from said wireless transmitter, and a controller in direct wired communication with said stationary motor and said receiver and adapted to control the operation of said stationary motor in response to receipt of the command by said receiver from said wireless transmitter.

42. A wheelchair lift in accordance with claim 41 wherein said wireless transmitter is an infrared transmitter and wherein said receiver is an infrared receiver.

43. A wheelchair lift in accordance with claim 41 and including a plurality of said receives in direct wired communication with said controller, and located on the stairway such that at least one of said receivers can receive the command regardless of the location of the mobile platform along the stairway.

44. A wheelchair lift in accordance with claim 43 wherein said receivers are positioned overhead of said transmitter.

45. A wheelchair lift comprising a stationary motor, a mobile platform driven by the stationary motor and adapted for carrying a wheelchair and its occupant along a stairway between upper and lower landings, and a control system including a receiver located on one of said platform and the stairway, a wireless transmitter located on the other of said platform and the stairway and adapted to communicate with said receiver only when said receiver is in close proximity with said transmitter, and a controller adapted to control the operation of said stationary motor in response to communication between said receiver and said transmitter.

46. A wheelchair lift in accordance with claim 45 wherein said wireless transmitter is an infrared transmitter, and wherein said receiver is an infrared receiver.

47. A wheelchair lift in accordance with claim 45 wherein one of said wireless transmitters is located along the wall of the stairway at a location at which the mobile platform stops.

48. A wheelchair lift in accordance with claim 45 wherein one of said wireless transmitters is located at a preselected location along the wall of the stairway at which it is desirable to vary the speed of movement of the mobile platform relative to the stairway.

* * * * *